US005645408A

United States Patent [19]

Fujio et al.

[11] Patent Number: 5,645,408

[45] Date of Patent: Jul. 8, 1997

[54] SCROLL COMPRESSOR HAVING OPTIMIZED OIL PASSAGES

[75] Inventors: Katsuharu Fujio, Koga-gun; Kiyoshi Sano, Otsu; Syouzou Hase, Hikone; Takashi Morimoto, Nagaokakyo; Shuichi Yamamoto, Otsu, all of Japan

[73] Assignee: Matsushita Electric Industrial Co., Ltd., Osaka-fu, Japan

[21] Appl. No.: 586,321

[22] Filed: Jan. 17, 1996

[30] Foreign Application Priority Data

Jan. 17, 1995 [JP] Japan ..... 7-004882

[51] Int. Cl.[6] ..... F04C 18/04; F04C 27/00; F04C 29/02

[52] U.S. Cl. ..... 418/55.4; 418/55.5; 418/55.6; 418/57; 418/94; 418/99

[58] Field of Search ..... 418/55.4, 55.5, 418/55.6, 57, 94, 99, 100, 91

[56] References Cited

U.S. PATENT DOCUMENTS

| | | | |
|---|---|---|---|
| 3,994,633 | 11/1976 | Shaffer | 418/5 |
| 4,395,205 | 7/1983 | McCullough | 418/55.4 |
| 5,106,279 | 4/1992 | Richardson, Jr. | 418/55.4 |
| 5,133,651 | 7/1992 | Onoda et al. | 418/55.6 |
| 5,178,527 | 1/1993 | Jung | 418/55.6 |
| 5,383,772 | 1/1995 | Richardson, Jr. et al. | 418/55.4 |

FOREIGN PATENT DOCUMENTS

| | | | |
|---|---|---|---|
| 55-142902A | 11/1980 | Japan . | |
| 55-142902 | 11/1980 | Japan . | |
| 02125989A | 5/1990 | Japan . | |
| 5-67796 | 3/1993 | Japan . | |
| 5141201 | 6/1993 | Japan | 418/55.4 |
| 5240175 | 9/1993 | Japan | 418/55.6 |
| 6123290 | 5/1994 | Japan | 418/55.4 |

*Primary Examiner*—John J. Vrablik
*Attorney, Agent, or Firm*—Wenderoth, Lind & Ponack

[57] ABSTRACT

A scroll compressor comprises a generally cylindrical casing and stationary and orbiting scrolls both accommodated in the casing. The stationary and orbiting scrolls engage with each other to define a plurality of compression chambers therebetween. The orbiting scroll is driven by a drive shaft which is in turn supported by a frame having a thrust bearing formed thereon. One of an orbiting end plate of the orbiting scroll and the thrust bearing has an annular groove defined therein in which an annular seal member is received. The orbiting scroll is disposed between the stationary scroll and the frame with an axial gap defined therebetween. First, second, and third back chambers are formed on the opposite side of the compression chambers with respect to the orbiting end plate. The first and second back chambers are partitioned by the annular seal member. The second back chamber is provided radially outwardly of the first back chamber and between the orbiting end plate and the thrust bearing, while the third back chamber is provided radially outwardly of the second back chamber. Oil passages are provided to introduce lubricating oil accommodated in the casing into the first chamber in which a discharge pressure acts. The oil passages act to supply part of the lubricating oil to the second chamber and then to the third chamber while reducing the pressure of the lubricating oil until the lubricating oil is eventually introduced into the suction chamber.

12 Claims, 5 Drawing Sheets

SCROLL COMPRESSOR HAVING OPTIMIZED OIL PASSAGES

BACKGROUND OF THE INVENTION

1. Field of the Invention

The present invention relates generally to a scroll compressor and, more particularly, to an oil circulation arrangement in the scroll compressor.

2. Description of Related Art

A scroll compressor featuring less vibrations and less noise has a suction chamber formed radially outwardly of two opposing scroll elements defining a plurality of volume-variable, sealed working pockets therebetween, and also has a discharge port formed centrally of the scroll elements. The scroll compressor allows a compression fluid to flow in one direction, and does not require a discharge valve for compressing the fluid, unlike a reciprocating compressor or a rotary compressor. It is also generally known that the scroll compressor has a constant compression ratio and generates relatively small discharge pulsations without requiring a large discharge space.

For further improving vibration and noise characteristics, a structure as shown in FIGS. 8 and 9 has been proposed to lessen a jumping phenomenon of an orbiting scroll during high-speed operations.

As shown in FIGS. 8 and 9, an orbiting scroll 1001 has an orbiting end plate 1001*a* coupled to a drive pin 1007*a* of a drive shaft 1007, while a stationary scroll 1002 opposing the orbiting scroll 1001 similarly has a stationary end plate 1002*a*. An outer peripheral portion of the orbiting end plate 1001*a* is slidably accommodated within a space defined between the stationary end plate 1002*a* and a frame 1008 carrying one end of the drive shaft 1007, to thereby prevent inclination of the orbiting scroll 1001 relative to the longitudinal direction of the drive shaft 1007 or jumping of the orbiting scroll 1001 in this direction when the compression load or the inertia forces of the rotating members change, for example, when the compressor starts, stops or operates at a high speed. An axial gap between the orbiting scroll 1001 and the stationary scroll 1002 is accordingly ensured to tightly seal a compression chamber, thus enhancing the compression efficiency. At the same time, abnormal noise or vibrations, which have been hitherto caused by an undesirable collision of the compressor elements, are reduced, and a decrease in durability of the sliding portions is avoided in the illustrated structure.

Moreover, with the aim of improving sealing properties of the compression chamber, the fluid in the compression chamber is introduced into a back chamber of the orbiting scroll 1001 on the opposite side to the compression chamber, so that the orbiting scroll 1001 may be pressed towards the stationary scroll 1002 by the fluid pressure in the back chamber to prevent the orbiting scroll 1001 from moving away from the stationary scroll 1002. This kind of construction is disclosed in, for example, Japanese Laid-Open Patent Publication (unexamined) No. 55-142902 or U.S. Pat. No. 3,994,633.

Japanese Patent Publication No. 5-67796 discloses a method of pressing the orbiting scroll toward the stationary scroll. According to this publication, a lubricating oil in a discharge chamber is introduced into a back chamber of the orbiting scroll on the side thereof opposite to the compression chamber.

It is generally known that the scroll compressor has a constant compression ratio and, hence, the pressure in the compression chamber when fluid compression is completed is determined by the suction pressure.

However, immediately after a completely compressed gas is discharged out from the discharge port to the discharge chamber, the pressure in the compression chamber in the vicinity of the discharge port becomes equal to that of the discharge port or discharge chamber.

As such, the actual pressure distribution in the compression chamber is influenced and changed by the pressure of the discharge chamber. Particularly, if the pressure in the discharge chamber is extraordinarily larger than the pressure of the compressed gas, even the pressure of the compression chamber near the suction chamber is influenced by the pressure of the discharge chamber as a result of a back flow of the gas from the discharge chamber and a leak of the gas from the compression chamber. Further, when the compressor operates at a low speed at which the leak rate from the compression chamber is relatively high and when the pressure in the discharge chamber is low, the pressure of the completely compressed gas becomes close to the pressure of the discharge chamber. In other words, the actual pressure in the compression chamber is influenced by the pressure in the discharge chamber.

Even when the back pressure to the orbiting scroll is so set as to properly press the orbiting scroll toward the stationary scroll upon a specific selection of the suction and discharge pressures, it is likely that this back pressure will become excessive or insufficient during actual driving of the compressor. Consequently, the problem arose that the orbiting scroll axially moves away from the stationary scroll, or is excessively pressed toward the stationary scroll, resulting in a reduction of the compression efficiency due to the leak of the compressed gas, or an increase of inputs and deterioration of the durability due to an increasing frictional resistance at the sliding portions.

To overcome this problem resulting from an unstable axial gap of the compression chamber, U.S. Pat. No. 4,395,205 discloses that the gas pressure in the compression chamber acting on the orbiting scroll is supported by a thrust bearing surface defined on a stationary member, without providing a back chamber on the side of the orbiting scroll opposite to the compression chamber. The thrust bearing surface is supplied with a lubricating oil.

This construction, however, introduces a large frictional loss between the orbiting scroll and the thrust bearing. It is also difficult to ensure a desired axial gap of the compression chamber at low cost, resulting in a large leakage rate of the compressed gas. For this reason, the compressor of the construction referred to above, particularly, that of a small capacity, has a low compression efficiency.

SUMMARY OF THE INVENTION

The present invention has been developed to overcome the above-described disadvantages.

It is accordingly an objective of the present invention to provide a scroll compressor having a high efficiency wherein sliding surfaces are properly supplied with a lubricating oil, and a load applied thereto is lessened. To this end, the scroll compressor has an oil circulation arrangement which enables any of a stationary scroll and a thrust bearing to support an orbiting scroll in order to cope with pressure changes in discharge and suction chambers.

Another objective of the present invention is to enhance the efficiency of the scroll compressor by uniformly feeding the lubricating oil to the sliding surfaces which support a compression or thrust load acting to separate the orbiting scroll from the stationary scroll and by making the lubricating oil smoothly flow in the whole oil circulation arrangement.

A further objective of the present invention is to improve the durability and compression efficiency and to reduce noise by supplying the lubricating oil sufficiently to the sliding portions where the orbiting scroll and a rotation constraint element for preventing rotation of the orbiting scroll about its own axis engage with each other.

In accomplishing the above and other objectives, the scroll compressor according to the present invention comprises a generally cylindrical casing and stationary and orbiting scroll members both accommodated in the cylindrical casing. The stationary scroll member has a stationary end plate and a stationary scroll wrap protruding axially from the stationary end plate. The stationary scroll member also has a discharge port defined therein at a central portion thereof and a suction chamber formed outside the stationary scroll wrap. The orbiting scroll member similarly has an orbiting end plate and an orbiting scroll wrap protruding axially from the orbiting end plate so as to engage with the stationary scroll wrap to define a plurality of compression chambers therebetween. A drive shaft is rotatably accommodated in the cylindrical casing for orbiting the orbiting scroll member relative to the stationary scroll member. The drive shaft is supported by a frame having a thrust bearing formed thereon for axially supporting the orbiting end plate. Rotation of the orbiting scroll member about its own axis is prevented by a rotation constraint element. One of the orbiting end plate and the thrust bearing has an annular groove defined therein in which an annular seal member is received. The orbiting scroll member is disposed between the stationary scroll member and the frame with an axial gap defined therebetween.

Furthermore, the scroll compressor according to the present invention includes first, second, and third back chambers formed on an opposite side of the compression chambers with respect to the orbiting end plate. The first and second back chambers are partitioned by the annular seal member. The second back chamber is provided radially outwardly of the first back chamber and between the orbiting end plate and the thrust bearing, while the third back chamber is provided radially outwardly of the second back chamber. An oil passage means is provided to introduce lubricating oil accommodated in the cylindrical casing into the first chamber in which a discharge pressure acts. The oil passage means acts to supply a portion of the lubricating oil to the second chamber and then to the third chamber while reducing the pressure of the portion of the lubricating oil until the portion of the lubricating oil is eventually introduced into the suction chamber.

By the above-described construction, the compression load (thrust load) separating the orbiting scroll member from the stationary scroll member by the gas pressure in the compression chambers is reduced by a combined back pressure of a back pressure resulting from an oil pressure in the first back chamber and a back pressure resulting from oil pressures in the second and third back chambers which depend on a differential pressure between the discharge pressure and the suction pressure. When the orbiting scroll member is held in sliding contact with the stationary scroll member, sealing of the second back chamber is released to reduce the pressure in the second back chamber. On the other hand, when the orbiting scroll member is held in sliding contact with and supported by the thrust bearing, the second back chamber is appropriately sealed to increase the pressure inside it. The back pressure to the orbiting scroll member is adjusted in this manner. In any case, the orbiting end plate of the orbiting scroll member is slidably supported by either the stationary end plate of the stationary scroll member or the thrust bearing, so that the axial gap of the compression chamber is always maintained very small. The lubricating oil flowing from the first back chamber to the second and third back chambers lubricates sliding surfaces of the orbiting scroll member for smooth orbiting motion of the orbiting scroll member relative to the stationary scroll member. The lubricating oil entering the suction chamber via the third back chamber appropriately seals the axial gap of the compression chambers to thereby prevent leakage of the compressed gas and enhances the compression efficiency.

Advantageously, one of the orbiting end plate and the thrust bearing has an annular oil groove defined therein radially outwardly of the annular seal member so as to confront the second back chamber. In this case, the oil passage means comprises an oil passage defined in the orbiting end plate so as to extend therethrough and a bypass passage branched from the oil passage. The oil passage has at least one throttled portion and communicates the first back chamber with the third back chamber, while the bypass passage communicates the oil passage with the annular oil groove.

This construction stabilizes the minimum amount of oil to be fed because the oil passage and the bypass passage communicating the first back chamber with the second and third back chambers are separated from the sliding portions. Accordingly, the durability of the sliding surfaces between the orbiting end plate and the thrust bearing is ensured. The lubricating oil flowing from the first back chamber to the second back chamber via the annular oil groove is uniformly dispersed and stored in the entire second back chamber, thus stabilizing formation of an oil film which acts to avoid direct contact between the orbiting end plate and the thrust bearing to enhance the durability of the thrust bearing. Furthermore, the pressure in the second back chamber does not change so much and, hence, the gap of the compression chambers in the axial direction of the drive shaft is less changed, thus stabilizing the compression efficiency.

The orbiting scroll member has a plurality of grooves defined therein in which the rotation constraint element is engaged. It is preferred that the grooves of the orbiting scroll member communicate with the annular oil groove. By so doing, the lubricating oil in the first back chamber is always introduced into the grooves of the orbiting scroll member via the annular oil groove to thereby support an alternating load acting on engaging portions of the rotation constraint element. Accordingly, not only wear of the engaging portions between the orbiting scroll member and the rotation constraint element is prevented, but also the engaging angle between the orbiting and stationary scroll members is desirably maintained to prevent enlargement of a radial gap of the compression chambers (the gap perpendicular to the axial direction of the drive shaft), to thereby prevent a reduction in compression efficiency. Also, because sliding gaps in the engaging portions can be maintained small, generation of noise which has been hitherto caused by an undesirable collision of the rotation constraint element and its engaging members is minimized, thus realizing a scroll compressor having less noise characteristics.

Advantageously, one of the orbiting end plate and the thrust bearing has a discharged oil passage defined therein and having a throttled portion so as to communicate the annular oil groove with the third back chamber. In this case, the lubricating oil sent from the first back chamber to the second back chamber is held at an intermediate pressure between the pressure in the first back chamber and that in the third back chamber and close to the latter. The pressure in the second back chamber acts to move the orbiting scroll member towards the stationary scroll member, thus reducing the compression load acting on the orbiting scroll member or the thrust load acting on the thrust bearing. Accordingly, the input power required for compression is reduced and, hence, the compression efficiency is enhanced.

It is preferred that the bypass passage is positioned on the opposite side of the discharged oil passage. By so doing, the lubricating oil flowing from the first back chamber to the annular oil groove is dispersed to uniformly lubricate the thrust bearing surface, thus reducing the sliding resistance of the thrust bearing and enhancing the compression efficiency.

Conveniently, one of the discharged oil passage and the oil passage is open in the vicinity of one of a plurality of grooves defined in the frame in which the rotation constraint element is engaged. This construction ensures introduction of the lubricating oil in the first back chamber into the annular oil groove and then into the rotation constraint element engaging grooves of the frame, to thereby support the alternating load acting on the engaging portions of the rotation constraint element. Accordingly, not only wear of the engaging portions between the rotation constraint element and the frame is prevented, but also the engaging angle between the orbiting and stationary scroll members is desirably maintained to prevent enlargement of the radial gap of the compression chambers, to thereby prevent a reduction in compression efficiency. Also, because sliding gaps in the engaging portions can be maintained small, generation of noise which has been hitherto caused by an undesirable collision of the rotation constraint element and the frame is minimized.

Advantageously, the stationary end plate has an oil groove defined therein for communicating the third back chamber with the suction chamber. Preferably, the oil groove of the stationary end plate is positioned on the opposite side of at least one of the discharged oil passage and a downstream end of the oil passage with respect to the direction of flow of the lubricating oil. This construction allows the lubricating oil sent from the first back chamber to the third back chamber through the second back chamber or the oil passage to uniformly lubricate the sliding surfaces between the orbiting end plate of the orbiting scroll member and the stationary end plate of the stationary scroll member before entering the suction chamber. Accordingly, the frictional resistance is reduced to thereby enhance the compression efficiency and the durability of the compressor.

Again advantageously, the bypass passage intermittently introduces the lubricating oil accommodated in the first back chamber into the annular oil groove via the oil passage when the orbiting scroll member undergoes an orbiting motion relative to the stationary scroll member. By this construction, an oil entrance portion to the second back chamber is opened or closed in synchronization with the orbiting motion of the orbiting scroll member. Accordingly, when the compressor is operated at a high speed or at a low speed, the amount of oil to be fed to the compression chambers is reduced or increased, respectively, to thereby appropriately seal the gap of the compression chambers to minimize gas leakage from the compression chambers. As a result, the compression efficiency is enhanced.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
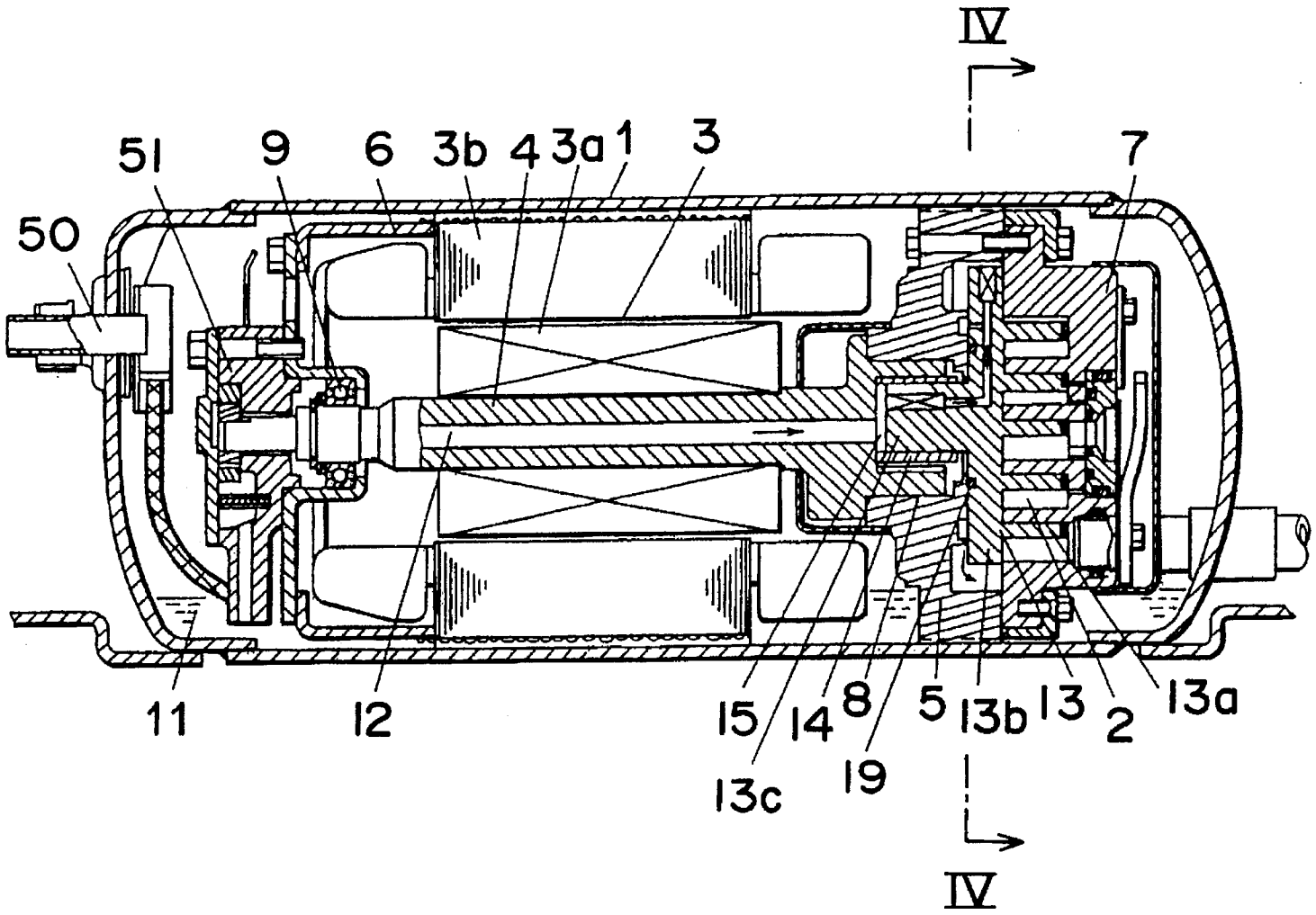
FIG. 1 is a vertical sectional view of a scroll compressor according to the present invention.

Referring now to the drawings, there is shown in FIG. 1 a scroll compressor embodying the present invention. The scroll compressor shown therein comprises a generally cylindrical closed casing 1 made of iron, an electric motor 3 accommodated within the closed casing 1 at a central portion thereof, a compression portion disposed on one side of the electric motor 3, and an oil pump assembly 51 disposed on the other side of the electric motor 3. The interior of the closed casing 1 substantially forms a high-pressure atmosphere communicating with a discharge pipe 50 which is secured to one end of the closed casing 1 so as to extend therethrough.

The compression portion comprises a main frame 5 secured to the closed casing 1, an auxiliary frame 6 secured to a stator **3*b* of the electric motor 3, and a stationary scroll 7 secured to the main frame 5. The main frame 5 has a main bearing 8 integrally formed therewith to support a drive shaft 4, to which a rotor 3*a* of the electric motor 3 is secured. The drive shaft 4 is also carried by an auxiliary bearing 9 mounted on the auxiliary frame 6, and is coupled at its one end with the oil pump assembly 51, a lower portion of which is immersed into an oil sump 11. The drive shaft 4 has an oil passage 12 defined therein so as to extend longitudinally thereof. The oil passage 12 communicates on one side thereof with the oil pump assembly 51 and on the other side thereof with the main bearing 8**.

Figure 2:
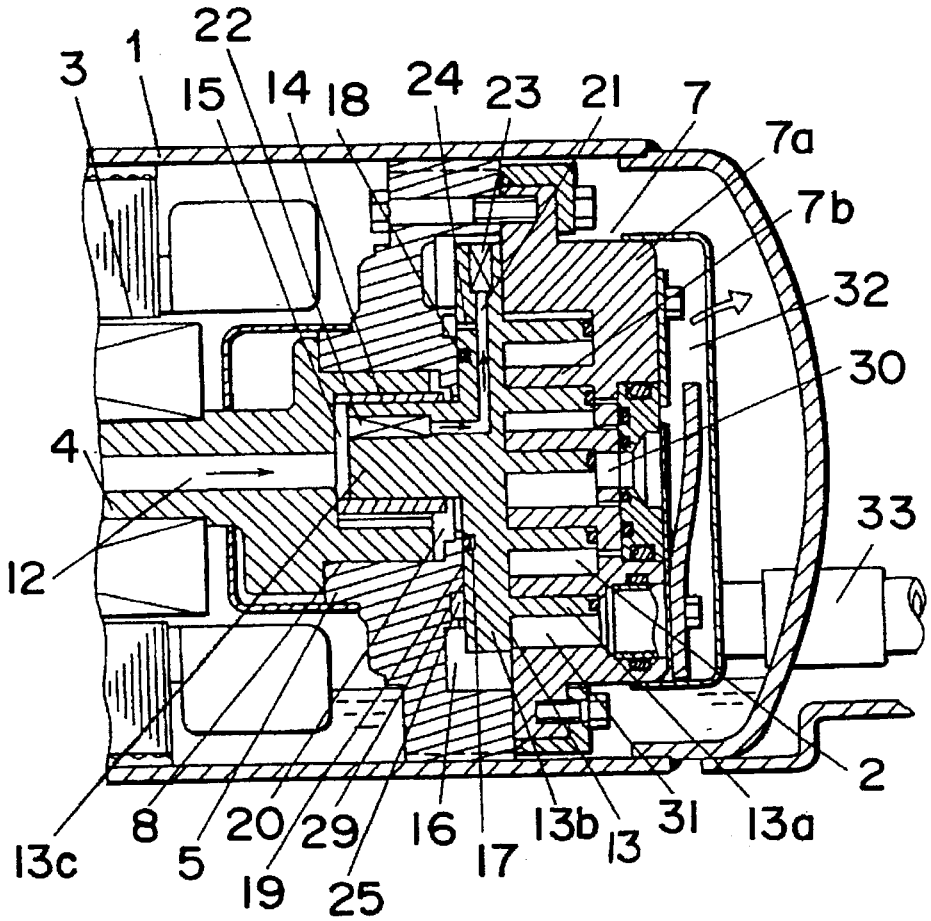
FIG. 2 is a fragmentary vertical sectional view of a compression mechanism accommodated in the scroll compressor of FIG. 1.

As shown in FIG. 2, the stationary scroll 7 includes a stationary end plate **7*a* and a spiral stationary scroll wrap 7*b* protruding axially from one end surface of the stationary end plate 7*a*. The stationary scroll 7 has a discharge port 30 defined therein so as to extend from a central portion of the stationary scroll wrap 7*b*. The stationary scroll 7 also has a suction chamber 31 formed inside it and outside the stationary scroll wrap 7*b*. The discharge port 30 communicates, via a discharge chamber 32 adjoining it, with a high-pressure space in which the electric motor 3 is placed. The suction chamber 31 communicates with a suction pipe 33 secured to the closed casing 1** so as to extend through a side wall thereof.

An orbiting scroll 13 engages with the stationary scroll 7 to define a plurality of volume-variable, sealed compression chambers 2 therebetween. The orbiting scroll 13 is disposed between the stationary scroll 7 and the main frame 5, and includes an orbiting end plate 13*b*, a spiral orbiting scroll wrap 13*a* protruding axially from one end surface of the orbiting end plate 13*b*, and an orbiting shaft 13*c* protruding axially from the other end surface of the orbiting end plate 13*b*.

The drive shaft 4 has an increased diameter end having a recess defined therein, in which an orbiting bearing 14 is eccentrically received, while the orbiting shaft 13*c* of the orbiting scroll 13 is inserted in the orbiting bearing 14.

The orbiting end plate 13*b* of the orbiting scroll 13 is interposed between the stationary scroll 7 and a thrust bearing 19 integrally formed with the main frame 5, with a very small gap defined between the former and one of the latter so that an oil film may be formed therebetween during operation of the compressor. The orbiting end plate 13*b* has an annular groove 17 formed substantially concentrically with the orbiting shaft 13*c* and confronting the thrust bearing 19, with an annular seal member 18 received in the annular groove 17.

Figure 3:
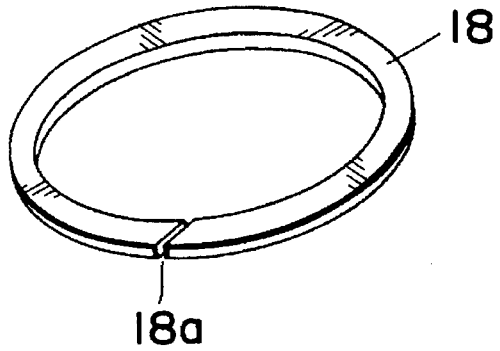
FIG. 3 is a perspective view of an annular seal member mounted in the compression mechanism of FIG. 2.

As shown in FIG. 3, the annular seal member 18 has a cutout 18*a* and is held in contact with an outer side wall of the annular groove 17 and with the thrust bearing 19, to thereby partition a space in which the orbiting end plate 13*b* is placed into a first back chamber 20 and a second back chamber 29 defined radially inwardly and outwardly of the annular seal member 18, respectively. The first back chamber 20 communicates with the oil passage 12 of the drive shaft 4 via a sliding surface between the main bearing 8 and the orbiting bearing 14. The second back chamber 29 is provided only between the orbiting end plate 13*b* and the thrust bearing 19.

An oil chamber 15 is formed inside the orbiting bearing 14 at a bottom portion thereof, while a third back chamber 16 is formed in the main frame 5 radially outwardly of the second back chamber 29. An oil passage 21 is formed in the orbiting scroll 13 to communicate the oil chamber 15 with the third back chamber 16. More specifically, the oil passage 21 includes a first passage portion defined in the orbiting shaft 13*c* so as to extend longitudinally thereof for communication with the oil chamber 15 and a second passage portion defined in the orbiting end plate 13*b* so as to extend radially thereof for communication with the third back chamber 16. The first passage portion has a throttled portion 22 confronting the oil chamber 15, while the second passage portion similarly has a throttled portion 23 confronting the third back chamber 16. A bypass passage 24 is branched axially from the second passage portion of the oil passage 21 so that an intermediate portion of the second passage portion intermittently communicates with an annular oil groove 25 formed in the end surface of the thrust bearing 19 when the orbiting scroll 13 undergoes an orbiting motion relative to the stationary scroll 7.

Figure 4:
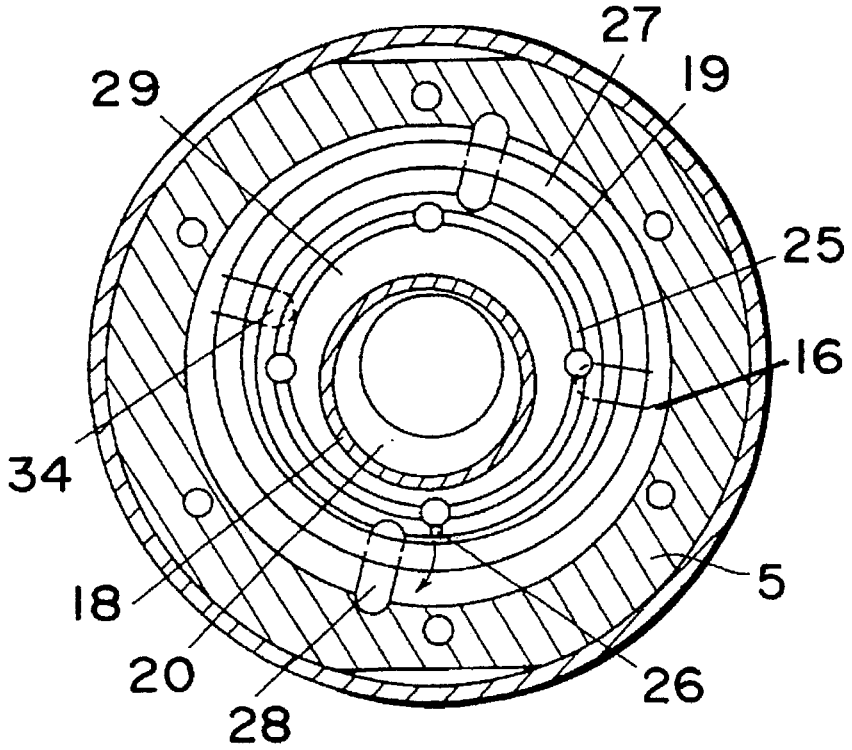
FIG. 4 is a sectional view taken along line IV—IV in FIG. 1.

As shown in FIG. 4, the annular oil groove 25 and the third back chamber 16 communicate with each other via a discharged oil passage 26 defined in the end surface of the thrust bearing 19 and having a throttled portion. This throttled portion renders the second back chamber 29 to have an intermediate pressure between the pressure of the first back chamber 20 and that of the third back chamber 16, and close to the pressure of the third back chamber 16. The discharged oil passage 26 is positioned on the opposite side of the bypass passage 24 and in the vicinity of one of a plurality of grooves 28 defined in the main frame 5, in which a rotation constraint element 27 for preventing rotation of the orbiting scroll 13 about its own axis is engaged. The annular oil groove 25 of the thrust bearing 19 intermittently communicates with a plurality of grooves 34 defined in the orbiting scroll 13, in which the rotation constraint element 27 is also engaged.

Figure 5:
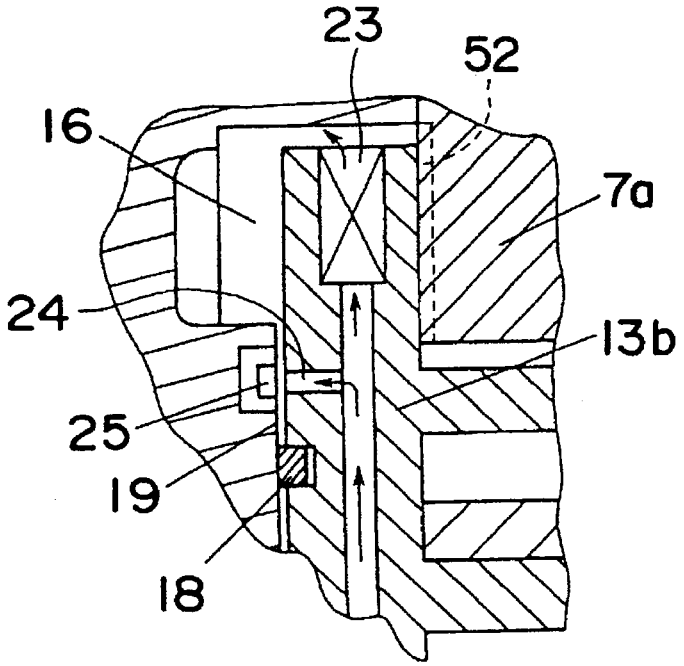
FIG. 5 is a fragmentary vertical sectional view of an orbiting scroll when it is held in sliding contact with a stationary scroll.

As shown in FIG. 5, the third back chamber 16 and the suction chamber 31 communicate with each other via an oil groove 52 defined in the end surface of the stationary end plate 7*a* in sliding contact with the orbiting end plate 13*b*. Although the oil groove 52 is illustrated in FIG. 5 as being close to the throttled portion 23, the oil groove 52 is positioned on the opposite side of at least one of the throttled portion 23 and the discharged oil passage 26.

The scroll compressor of the above-described construction operates as follows.

When the drive shaft 4 is driven by the electric motor 3, the orbiting scroll 13 supported by the thrust bearing 19 of the main frame 5 is caused to undergo an orbiting motion relative to the stationary scroll 7. The orbiting motion of the orbiting scroll 13 introduces refrigerant gas containing lubricating oil from a refrigeration cycle connected to the compressor into the suction chamber 31 via the suction pipe 33. The orbiting motion of the orbiting scroll 13 further introduces the refrigerant gas into the sealed compression chambers 2 defined between the stationary and orbiting scrolls 7 and 13 and causes the sealed compression chambers 2 to move inwardly around the stationary and orbiting scroll wraps 7*b* and 13*a* towards the center discharge port 30, accompanied by progressive reduction in volume thereof. Therefore, the refrigerant gas trapped into each compression chamber 2 experiences a decrease in volume and an increase in pressure as it approaches the center discharge port 30 and is subsequently discharged into the discharge chamber 32 through the center discharge port 30. The refrigerant gas is eventually discharged outside the compressor through the discharge pipe 50, while cooling the electric motor 3. Although the refrigerant gas discharged into the discharge chamber 32 still contains the lubricating oil, the refrigerant gas is separated from the lubricating oil on its way to the discharge pipe 50, with the lubricating oil collected in the oil sump 11.

Part of the lubricating oil, upon which the discharge pressure acts, is supplied to the auxiliary bearing 9 by the oil pump assembly 51, while the remaining lubricating oil is mostly introduced into the oil chamber 15 through the oil passage 12 defined in the drive shaft 4. Most of the lubricating oil introduced into the oil chamber 15 is returned to the oil sump 11 via the orbiting bearing 14 and the main bearing 8. The first back chamber 20 partitioned by and defined inwardly of the annular seal member 18 is filled with part of the lubricating oil passing through the orbiting bearing 14. Part of the lubricating oil in the oil chamber 15 is eventually introduced into the third back chamber 16 through the cutout 18*a* of the annular seal member 18, the sliding surfaces between the orbiting scroll 13 and the thrust bearing 19, and the oil passage 21 defined in the orbiting scroll 13.

The lubricating oil passing through the oil passage 21 is first reduced in pressure at the throttled portion 22 upstream of the oil passage 21 in a direction of flow of the lubricating oil. Part of the lubricating oil is introduced into the annular oil groove 25 defined in the thrust bearing 19 through the bypass passage 24, while the remaining lubricating oil is further reduced in pressure at the throttled portion 23 downstream of the oil passage 21, and is introduced into the third back chamber 16, the internal pressure of which is substantially equal to that of the suction chamber 31.

The lubricating oil in the oil passage 21 is affected by a passage resistance when the orbiting motion of the orbiting scroll 13 causes the bypass passage 24 to intermittently communicate with the annular oil groove 25. More specifically, at a low orbiting speed, a certain amount of lubricating oil passing through the oil passage 21 is introduced into the annular oil groove 25, whereas at a high orbiting speed, a lesser amount of lubricating oil is introduced into the annular oil groove 25.

The lubricating oil in the annular oil groove 25 slightly leaks radially outwardly of the annular oil groove 25 towards the third back chamber 16 to lubricate the end surface of the thrust bearing 19. At the same time, the lubricating oil in the annular oil groove 25 is introduced into the third back chamber 16 while being reduced in pressure when it passes through the discharged oil passage 26 having a throttled portion and positioned on the opposite side of the bypass passage 24 to lubricate the rotation constraint element engaging grooves 28 located in the vicinity of the discharged oil passage 26. The lubricating oil in the annular oil groove 25 is also reduced in pressure when it is intermittently introduced into the third back chamber 16 via the grooves 34 of the orbiting scroll 13.

Having lubricated the rotation constraint element engaging grooves 28, the lubricating oil flows towards the oil groove 52 of the stationary end plate **7*a* on the opposite side of the discharged oil passage 26 and is then introduced into the suction chamber 31 while lubricating the peripheral sliding portions together with the lubricating oil discharged from the grooves 34 of the orbiting scroll 13 and that discharged from the periphery of the thrust bearing 19**.

Figure 6:
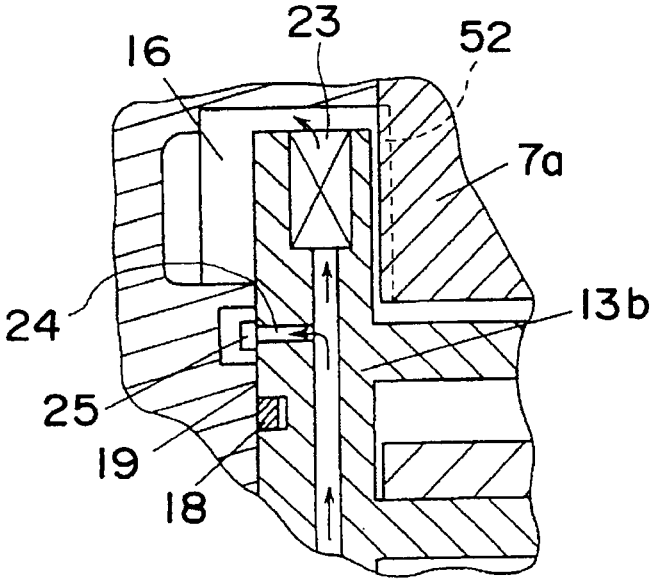
FIG. 6 is a view similar to FIG. 5, but indicating the orbiting scroll when it is held in sliding contact with a thrust bearing.

The pressure of the refrigerant gas in the compression chambers 2 acts to move the orbiting scroll 13 away from the stationary scroll 7 in a direction axially of the drive shaft 4. (This pressure is hereinafter referred to as the separation pressure). On the other hand, the orbiting end plate **13*b* of the orbiting scroll 13 receives a composite pressure of the pressure in the first back chamber 20 (the portion encircled by the annular seal member 18) in which the discharge pressure acts, and the pressure in the second back chamber 29 in which an intermediate pressure between the discharge pressure and the suction pressure and close to the suction pressure acts. In short, the separation pressure and the composite back pressure act to cancel one another. Accordingly, when the composite back pressure is greater than the separation pressure, the orbiting end plate 13*b* is supported by the stationary end plate 7*a* of the stationary scroll 7, as shown in FIG. 5. In this case, a small gap is generated between the orbiting end plate 13*b* and the thrust bearing 19 to reduce the pressure in the second back chamber 29, resulting in a reduction of the composite back pressure. In contrast, when the separation pressure is greater than the composite back pressure, the orbiting end plate 13*b* is supported by the thrust bearing 19, as shown in FIG. 6. In this case, the second back chamber 29 tends to be sealed by an oil film formed on sliding surfaces between the orbiting end plate 13*b* and the thrust bearing 19, resulting in an increase of the back pressure in the second back chamber 29. In any case, the axial contact force of the orbiting scroll 13 with the stationary scroll 7 is regulated so as to reduce leakage and frictional losses. Furthermore, a small gap is held between the orbiting end plate 13*b*** and the sliding surfaces with an oil film formed therebetween, thus reducing a sliding resistance.

Even when the orbiting end plate **13*b* of the orbiting scroll 13 is supported by either the stationary end plate 7*a* of the stationary scroll 7 or the thrust bearing 19, the gap of the compression chambers 2** is very small and is sealed by an oil film of the lubricating oil flowing thereinto.

According to the scroll compressor of the construction referred to above, a compression or thrust load, which is generated by the refrigerant gas in the compression chambers 2 so as to move the orbiting scroll 13 away from the stationary scroll 7 in a direction axially of the drive shaft 4, is reduced by a back pressure of a value between the oil pressure in the first back chamber 20 in which the discharge pressure acts and the pressure in the second back chamber 29 close to that in the third back chamber 16 which is also close to the suction pressure. Furthermore, the orbiting end plate **13*b* is slidably supported by either the stationary end plate 7*a* of the stationary scroll 7 or the thrust bearing 19. Accordingly, an excessive axial contact force of the orbiting scroll 13 with the stationary scroll 7 is eliminated to thereby reduce the input power required for compression and enhance the durability of the compressor. In particular, when the orbiting end plate 13*b* is held in sliding contact with the stationary end plate 7*a* of the stationary scroll 7 or the thrust bearing 19, the pressure in the second back chamber 29 is regulated so as to reduce or increase, respectively. This phenomenon reduces the compression load (thrust load) and, hence, contributes to a reduction in compression input. Also, because the sliding surfaces of the orbiting end plate 13*b* of the orbiting scroll 13 are lubricated by the lubricating oil introduced from the first back chamber 20 into the second and third back chambers 29 and 16, the friction loss on the sliding surfaces is reduced. In addition, because the lubricating oil supplied to the sliding surfaces of the orbiting end plate 13*b*** is introduced into the compression chambers, the gap of the compression chambers is appropriately sealed by an oil film resulting therefrom, thereby preventing leakage of the refrigerant gas during compression and enhancing the compression efficiency.

Figure 7:
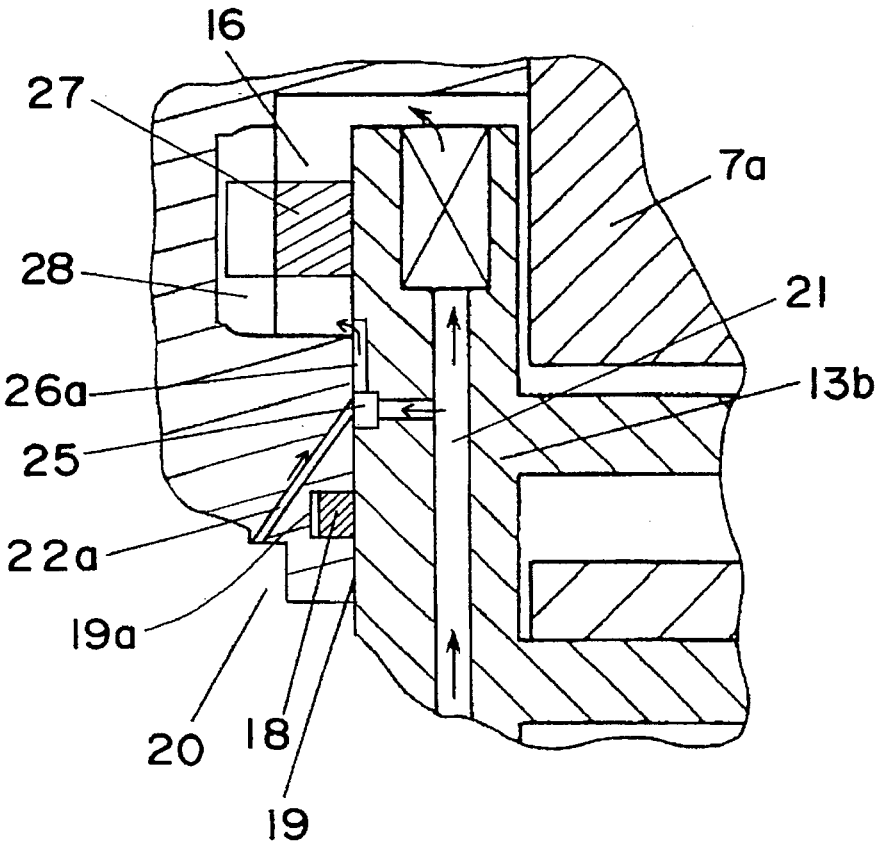
FIG. 7 is a view similar to FIG. 6, but indicating a modification thereof.
Figure 8:
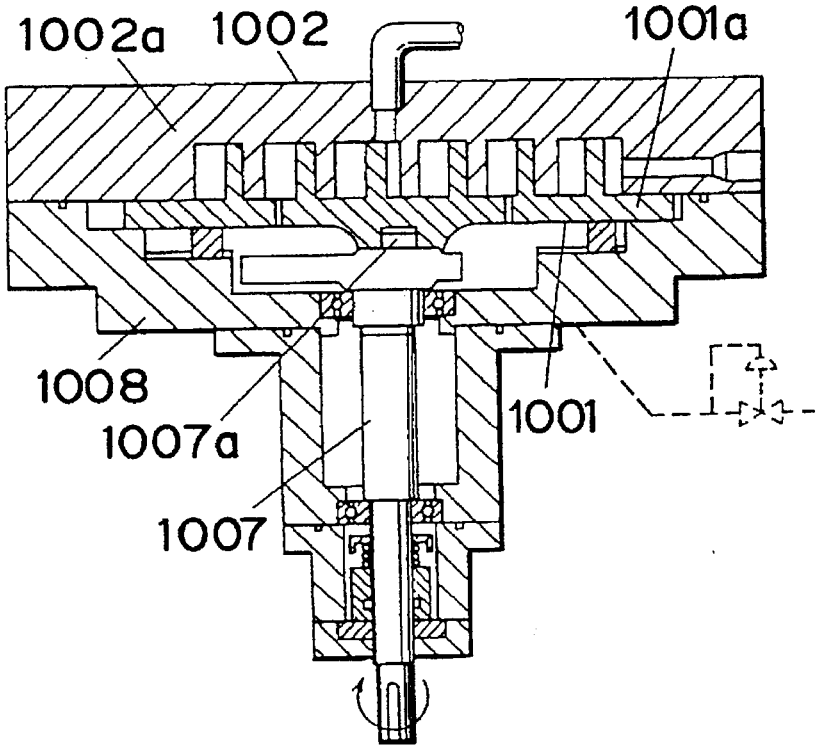
Fig. 8 PRIOR ART
FIG. 8 is a vertical sectional view of a compression mechanism mounted in a conventional scroll compressor.
Figure 9:
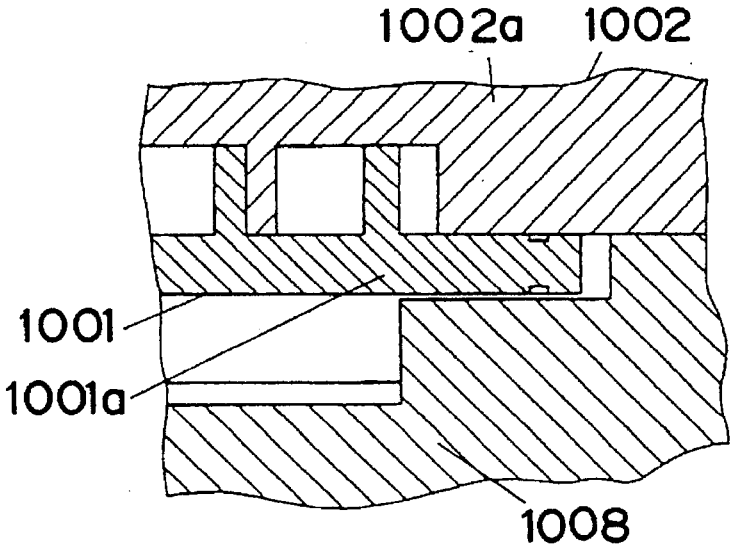
Fig. 9 PRIOR ART
FIG. 9 is a fragmentary vertical sectional view of orbiting and stationary scrolls mounted in the compression mechanism of FIG. 8.

Although in the above-described embodiment the annular seal member 18 is mounted on the orbiting end plate **13*b*, it may be received in an annular groove 19*a* defined in the thrust bearing 19, as shown in FIG. 7**.

Furthermore, although in the above-described embodiment the annular oil groove 25 is formed in the thrust bearing 19, it may be formed in the orbiting end plate **13*b*, as shown in FIG. 7. In this case, the annular oil groove 25 may be communicated with the rotation constraint element engaging grooves 28 via a discharged oil passage 26*a* defined in the orbiting end plate 13*b* in the vicinity of one of the rotation constraint element engaging grooves 28. Also, the main frame 5 may have a throttled oil passage 22*a* defined therein so as to extend therethrough to communicate the first back chamber 20 and the annular oil groove 25** with each other.

Although in the above-described embodiment the pressure in the second back chamber 29 is set to be an intermediate pressure between the discharge pressure and the suction pressure, it may be so set as to be substantially equal to the pressure in the third back chamber 16 according to the range of changes in discharge and suction pressures. Moreover, although the pressure in the third back chamber 16 may be substantially equal to that in the suction chamber 31, it may be so set as to be an intermediate pressure between the pressure in the second back chamber 29 and that in the suction chamber 31 according to the range of changes in discharge and suction pressures.

Although the refrigerant compressor has been discussed above, the present invention is also applicable to a gas compressor employing nitrogen, oxygen, helium or the like.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A scroll compressor comprising:

a generally cylindrical casing;

a stationary scroll member accommodated in said cylindrical casing and having a stationary end plate and a stationary scroll wrap protruding axially from said stationary end plate, said stationary scroll member also having a discharge port defined therein at a central portion thereof and a suction chamber formed outside said stationary scroll wrap;

an orbiting scroll member accommodated in said cylindrical casing and having an orbiting end plate and an orbiting scroll wrap protruding axially from said orbiting end plate so as to engage with said stationary scroll wrap to define a plurality of compression chambers therebetween, said orbiting end plate having an oil passage defined therein;

a drive shaft rotatably accommodated in said cylindrical casing for orbiting said orbiting scroll member relative to said stationary scroll member;

a frame for rotatably supporting said drive shaft, said frame having a thrust bearing formed thereon for axially supporting said orbiting end plate;

a rotation constraint element for preventing rotation of said orbiting scroll member about its own axis;

an annular seal member received in an annular groove defined in one of said orbiting end plate and said thrust bearing;

said orbiting scroll member being disposed between said stationary scroll member and said frame with an axial gap defined therebetween;

first, second, and third back chambers formed on an opposite side of said orbiting end plate with respect to said compression chambers, said first and second back chambers being partitioned by said annular seal member, said second back chamber being provided radially outwardly of said first back chamber and between said orbiting end plate and said thrust bearing, said third back chamber being provided radially outwardly of said second back chamber; and an oil passage means for introducing lubricating oil accommodated in said cylindrical casing into said first chamber in which a discharge pressure acts, said oil passage means supplying a portion of said lubricating oil to said second chamber and then to said third chamber through said oil passage in said orbiting end plate while reducing a pressure of said portion of said lubricating oil until said portion of said lubricating oil is eventually introduced into said suction chamber.

2. A scroll compressor comprising:

a generally cylindrical casing;

a stationary scroll member accommodated in said cylindrical casing and having a stationary end plate and a stationary scroll wrap protruding axially from said stationary end plate, said stationary scroll member also having a discharge port defined therein at a central portion thereof and a suction chamber formed outside said stationary scroll wrap;

an orbiting scroll member accommodated in said cylindrical casing and having an orbiting end plate and an orbiting scroll wrap protruding axially from said orbiting end plate so as to engage with said stationary scroll wrap to define a plurality of compression chambers therebetween;

a drive shaft rotatably accommodated in said cylindrical casing for orbiting said orbiting scroll member relative to said stationary scroll member;

a frame for rotatably supporting said drive shaft, said frame having a thrust bearing formed thereon for axially supporting said orbiting end plate;

a rotation constraint element for preventing rotation of said orbiting scroll member about its own axis;

an annular seal member received in an annular groove defined in one of said orbiting end plate and said thrust bearing;

said orbiting scroll member being disposed between said stationary scroll member and said frame with an axial gap defined therebetween;

first, second, and third back chambers formed on an opposite side of said orbiting end plate with respect to said compression chambers, said first and second back chambers being partitioned by said annular seal member, said second back chamber being provided radially outwardly of said first back chamber and between said orbiting end plate and said thrust bearing, said third back chamber being provided radially outwardly of said second back chamber;

an oil passage means for introducing lubricating oil accommodated in said cylindrical casing into said first chamber in which a discharge pressure acts, said oil passage means supplying a portion of said lubricating oil to said second chamber and then to said third chamber while reducing a pressure of said portion of said lubricating oil until said portion of said lubricating oil is eventually introduced into said suction chamber; and wherein one of said orbiting end plate and said thrust bearing has an annular oil groove defined therein radially outwardly of said annular seal member so as to confront said second back chamber, and wherein said oil passage means comprises an oil passage defined in said orbiting end plate so as to extend therethrough and a bypass passage branched from said oil passage, said oil passage having at least one throttled portion and communicating said first back chamber with said third back chamber, said bypass passage communicating said oil passage with said annular oil groove.

3. The scroll compressor according to claim 2, wherein said oil passage intermittently introduces said lubricating oil accommodated in said first back chamber into said annular oil groove via said bypass passage when said orbiting scroll member undergoes an orbiting motion relative to said stationary scroll member.

4. The scroll compressor according to claim 2, wherein said orbiting scroll member has a plurality of grooves defined therein in which said rotation constraint element is engaged, said grooves of said orbiting scroll member communicating with said annular oil groove.

5. The scroll compressor according to claim 4, wherein one of said orbiting end plate and said thrust bearing has a discharged oil passage defined therein and having a throttled portion, said discharged oil passage communicating said annular oil groove with said third back chamber.

6. The scroll compressor according to claim 5, wherein said bypass passage is positioned on an opposite side of said discharged oil passage.

7. The scroll compressor according to claim 5, wherein one of said discharged oil passage and said oil passage is open in a vicinity of one of a plurality of grooves defined in said frame in which said rotation constraint element is engaged.

8. The scroll compressor according to claim 5, wherein said stationary end plate has an oil groove defined therein for communicating said third back chamber with said suction chamber, said oil groove of said stationary end plate being positioned on an opposite side of at least one of said discharged oil passage and a downstream end of said oil passage with respect to a direction of flow of said lubricating oil.

9. The scroll compressor according to claim 2, wherein one of said orbiting end plate and said thrust bearing has a discharged oil passage defined therein and having a throttled portion, said discharged oil passage communicating said annular oil groove with said third back chamber.

10. The scroll compressor according to claim 9, wherein said bypass passage is positioned on an opposite side of said discharged oil passage.

11. The scroll compressor according to claim 9, wherein one of said discharged oil passage and said oil passage is open in a vicinity of one of a plurality of grooves defined in said frame in which said rotation constraint element is engaged.

12. The scroll compressor according to claim 9, wherein said stationary end plate has an oil groove defined therein for communicating said third back chamber with said suction chamber, said oil groove of said stationary end plate being positioned on an opposite side of at least one of said discharged oil passage and a downstream end of said oil passage with respect to a direction of flow of said lubricating oil.

* * * * *